United States Patent [19]

Robertson

[11] 4,038,445

[45] July 26, 1977

[54] COATED PAPER

[75] Inventor: Neil George Douglas Robertson, Marlow Bottom, England

[73] Assignee: Wiggins Teape Limited, London, England

[21] Appl. No.: 590,681

[22] Filed: June 26, 1975

[30] Foreign Application Priority Data

July 4, 1974 United Kingdom ..... 29729/74

[51] Int. Cl.[2] ..... B05D 3/12; B05D 3/02

[52] U.S. Cl. ..... 427/150; 427/369; 427/373; 427/345; 427/358; 427/153; 282/27.5; 260/2.5 B

[58] Field of Search ..... 427/358, 6, 369, 150, 427/153, 345, 373; 428/262, 310, 314, 315; 264/48, 321; 260/2.5 B; 282/27.5

[56] References Cited

U.S. PATENT DOCUMENTS

| | | | |
|---|---|---|---|
| 3,607,341 | 9/1971 | Goins et al. | 427/373 X |
| 3,897,578 | 7/1975 | Kanda et al. | 427/358 |

*Primary Examiner*—Michael R. Lusignan

*Attorney, Agent, or Firm*—Burns, Doane, Swecker & Mathis

[57] ABSTRACT

Microcapsule coated sheet material for use in pressure sensitive copying systems is produced by a method which comprises forming an aqueous coating composition containing microcapsules, particulate stilt material and a biner, foaming the coating composition, applying the foamed composition to a web of sheet material, and metering the composition on the web to a desired coating weight by means of a metering member, for example a blade which preferably is flexible, in contact with the coating composition on the web. The foamed composition is preferably applied to the web by means of a fountain applicator.

8 Claims, 4 Drawing Figures

COATED PAPER

BACKGROUND OF THE INVENTION

This invention relates to coated sheet material, and particularly to the production of microcapsule coated paper for use in pressure sensitive copying systems.

One such copying system, known as a transfer system, comprises an upper sheet, known as a CB sheet, coated on its lower surface with microcapsules containing a solution of a colourless colour former and a lower sheet, known as a CF sheet, coated on its upper surface with an acidic colour-reactive material, for example a clay, a phenolic resin or certain organic salts. For most applications, a number of intermediate sheets, known as CFB sheets, are also provided, each of which is coated on its lower surface with microcapsules and on its upper surface with acidic colour-reactive material. Pressure exerted on the sheets by writing or typing ruptures the microcapsules, thereby releasing the colour former solution onto the acidic material on the next lower sheet, and giving rise to a chemical reaction which develops the colour of the colour former.

Another such copying system, known as a self-contained system, comprises at least one sheet coated on its upper surface with both microcapsules and acidic colour-reactive material. Again, pressure exerted on the sheets by writing or typing ruptures the capsules, thereby releasing the colour former solution onto adjacent colour reactive material and so developing the colour of the colour former.

As well as microcapsules, a coating composition for producing CB, CFB and self-contained sheets generally contains a binder and a so-called stilt material. The latter is a protective agent for preventing premature rupture of the capsules, for example during storage and handling of the sheets. The stilt material is particulate in nature. The particles thus support the sheet if it is subjected to relatively light pressures, for example those involved in handling and storage, and thus prevent the microcapsules from being subjected to pressure which might rupture them. However, if high pressures are applied, as is the case during writing or typing, the protection afforded by the stilt material is insufficient to prevent microcapsule rupture.

The binder serves to enhance the adhesion of the microcapsules and the stilt material particles to the base paper.

In the copying systems described above, it is desirable that the microcapsule-containing coating extends completely and evenly over the whole area of the CB, CFB and self-contained sheets, so as to ensure that all areas of the sheet are capable of generating a copy. It is also desirable for economic reasons to use a low coatweight of microcapsule-containing composition. The achievement of the desired combination of complete even coverage and low coatweight presents practical and economic problems, as will now be discussed.

Hitherto, it has been a common practice to apply microcapsule-containing coatings to the paper as aqueous dispersions at a low solids content, and then to meter the coating applied using an air-knife. A low solids content coating composition, e.g. 18% solids content, permits the use of a fairly thick wet film, which ensures complete coverage and results in the desired low coatweight once the water has been removed. Moreover, an acceptably even coating is obtained, since air knife metering results in a coating which tends to "follow" the "hills" and "valleys" in the paper, rather than filling in the "valleys" and leaving the "hills" with a low coatweight. However, the procedure just described has a number of disadvantages. Firstly, the use of a lower solids content coating composition means that large amounts of water have to be removed from the coated web of paper (a high solids coating composition cannot be satisfactorily air-knife coated, since its higher viscosity means that the flow properties of the mix are not adequate to permit metering by a jet of air). Secondly, the speed at which coating may be carried out is limited by the problem of "misting". This is due to the fact that the metering jet of air tends to blow droplets of liquid off the web giving rise to a "mist", which may subsequently be redeposited either on the paper, which gives an uneven coating pattern, or on the tip of the air knife, which disturbs the evenness of the metering jet of air and thus gives rise to an uneven coating pattern. The problem becomes progressively worse at higher coating speeds, since the pressure of the metering jet of air is greater. Skilful operation can minimize this problem, but it does represent a constraint on high speed operation. Thirdly, particles of stilt material tend to be selectively blown off the wet coating on the web, although again this problem can be overcome to some extent by skilled operation of the coater. Fourthly, air knife coating is only effective for use on webs of up to a certain deckle, so far as we are aware.

If it is sought to overcome the above described problems by using blade metering rather than air knife metering, it is difficult to achieve the desired combination of low coat-weight and complete even coverage, with a good coating pattern. In order to achieve complete coverage, it is still necessary to apply a fairly thick wet coating, but a blade is not normally usable to meter a coating having a low viscosity, for example below about 200 cP Brookfield. A low solids content microcapsule mix of, for example 18% solids has a lower viscosity than this. If a higher solids coating composition is employed, in order to achieve a higher viscosity, either an uneven coating pattern results or an uneconomically high coatweight has to be applied to achieve an even pattern after water removal. This problem is exacerbated by the fact that although blade metering gives a smooth surface, it may result in an uneven film thickness, since in contrast to an air knife the "valleys" in the paper are filled in and the "hills" have a low coatweight.

It might be thought that the viscosity could be simply increased by the addition of a thickener. However, a thickener does not increase the wet film thickness and hence an uneconomically thick wet coating would still be needed in order to ensure complete coverage.

The presence of particulate stilt materials in the coating mix leads to further problems in the use of a blade coater. Firstly, the blade may cause selective removal of stilt material, which is then returned to the coating pan with the excess coating removed by the blade. In consequence, the viscosity of the coating composition in the coating pan increases, and control of lightweight coatings becomes increasingly difficult. This problem is particularly serious when cellulose fibre floc is used as the stilt material (cellulose fibre floc has hitherto been probably the most widely used stilt material, although other materials have been proposed, for example, wheat starch, granular synthetic polymers and certain mineral materials). Secondly, particles of stilt material tend to pack beneath the tip of the blade which leads to low coatweight streaks in the coating. Moreover, parts of the blade may lift intermittently to release the packed particles of stilt material, which leads to the production of "strips" of excessively high coatweight.

BRIEF SUMMARY OF THE INVENTION

We have now discovered that the aforementioned problems hitherto encountered in the coating of compositions containing microcapsules or microcapsules and particulate stilt materials may be overcome, or at least reduced, if the coating composition is foamed before being coated.

According to a first aspect of the invention, there is provided a method of coating a web of sheet material with a coating composition containing microcapsules, comprising the steps of foaming the composition, applying the foamed composition to the web, and metering the composition on the web to a desired coatweight by means of a metering member in contact with the composition on the web. The coating composition may also contain a particulate stilt material.

According to a second aspect of the invention, there is provided paper which has been coated by a method according to a first aspect of the invention.

Preferably the metering member is a blade. The blade may for example be a rigid blade or, preferably, a flexible blade. By a flexible blade is meant one which flexes in the direction of web movement to substantially the same extent across the whole width of the blade. Its surface facing the web is thus convex, and the degree of convexity may be such that the web runs tangentially to the blade, with the point of contact of the web and the blade being at, or spaced from, the tip of the blade. In contrast a so-called rigid blade flexes only to a slight extent and is normally in edge contact with the web. The present method is of course applicable to blades of any degree of flexing from a so-called rigid blade in edge contact with the web to a blade which flexes sufficiently to be tangential to the web. If desired, the blade may be part of a flooded nip inverted blade coater or of a so-called Bill-blade coater (for example as described in British Patent No. 1,115,133) or of a so-called Twin blade coater (for example as described in British Patent No. 1,373,998). A fountain applicator has been found particularly suitable for applying the foamed coating composition to the web, especially when the metering member is a flexible blade.

Although it has been found preferable for the metering member to be a blade, it need not necessarily be so. Instead, the metering member may for example be a Meyer bar or the roll of a so-called Champflex coater.

The foamed coating composition may have a wide range of air (or other gas) contents, for example from about 25% to about 75%. Preferably, however, the air content is from 45% to 70%. Limits of 25% and 75% do not represent upper and lower limits to the air contents which may be used, although as the air content gets lower than the lowest value quoted above, the previously described disadvantages of conventional blade coating tend to become apparent. To some extent the upper and lower permissible air contents are dependent on the other parameters of the coating composition, for example its solids content, viscosity and other constituents.

The solids content of the coating composition has in general been found not to be critical, in that compositions with a wide range of solids content have been successfully coated. The use of a foamed coating composition permits application of compositions of higher solids content than those conventionally applied, for example 50% solids or more. Generally, it has been found that it may be advantageous to employ a higher air content for a high solids content coating composition.

Although viscosity of the coating composition influences almost any coating operation, it has been found that the present coating method may be used successfully for coating compositions of widely differing viscosities, for example 200 to 3,500 cP Brookfield, i.e. much the same range as is normally used in blade coating operations in the paper industry. Alteration in viscosity may be achieved in the present method by suitable choice of air content. The method and materials used in production of the microcapsules and the coating composition are also significant. For example a coating composition containing microcapsules of gelatin and carboxymethyl cellulose (CMC) may have a higher viscosity than a composition containing urea-formaldehyde capsules.

The mean bubble size of the foam and the distribution of bubble sizes about the mean size affect the viscosity or coatability of the mix. A narrow distribution of bubble sizes about the mean bubble size is preferable. The bubble sizes in the foamed coating composition used in the exemplified coating runs to be described hereafter predominantly fall in the range 10 to 100 $\mu$m, with a mean bubble size of from about 30 to 50 $\mu$m.

The nature of the paper to be coated appears to influence the properties of the finished coating in much the same way as is found in conventional blade coating. The influence of base paper on coating properties is well known, and will not therefore be discussed further herein.

The present method can be carried out over a wide range of coating speeds, for example from around 250 m/min to around 725 m/min. These figures are not thought to represent the process limits.

A wide range of foaming agents may be used, although care must be taken to ensure that the foaming agent will not react with the microcapsule walls. This tends to happen with gelatin/CMC capsules if synthetic foaming agents are used, and consequently foaming agents which are natural products are preferred for those and similar capsules. Suitable foaming agents include the following water-soluble polymers: polyvinyl alcohol (PVA), natural products, e.g. proteins such as gelatin, casein and soyabean extract, saponin, and in addition, for urea formaldehyde walled capsules, synthetic surfactants, particularly non-ionic surfactants. The agents just listed are not necessarily all suitable for use with every type of microcapsule. It should of course be appreciated that some coating compositions can be foamed satisfactorily without the use of an additional foaming agent. For example, the binder used may itself produce an adequate foam. Examples of binders in this category are the proteins mentioned above and polyvinyl alcohol.

The foamed dispersion can be produced in any convenient way. It has been found that, although when in a dry state the microcapsules are easily ruptured by mechanical pressure, it is possible to subject an aqueous suspension of the microcapsules to the high shear imparted by many high speed mixers without causing a significant amount of damage to the microcapsules. Thus such mixers can be used as part of the foam forming apparatus. Two types of foam producing apparatus which may be used in the present method will be described in greater detail by way of example hereafter.

The stilt materials in the composition to be foamed may be, for example, cellulose fiber floc, granular starch particles, granular synthetic polymers, hollow or liquid containing capsules of a size greater than that of the microcapsules in the composition, or particulate mineral materials e.g. talc or pigments, or other particulate materials of suitable size and non-abrasive nature which can be readily introduced into the mix before foaming.

BRIEF DESCRIPTION OF THE DRAWINGS

In order to enable the invention to be more readily understood, reference will now be made to the accompanying drawings, which illustrate diagrammatically and by way of example apparatus which may be used in practising the invention, and in which.

DESCRIPTION OF THE PREFERRED EMBODIMENTS

Figure 1:
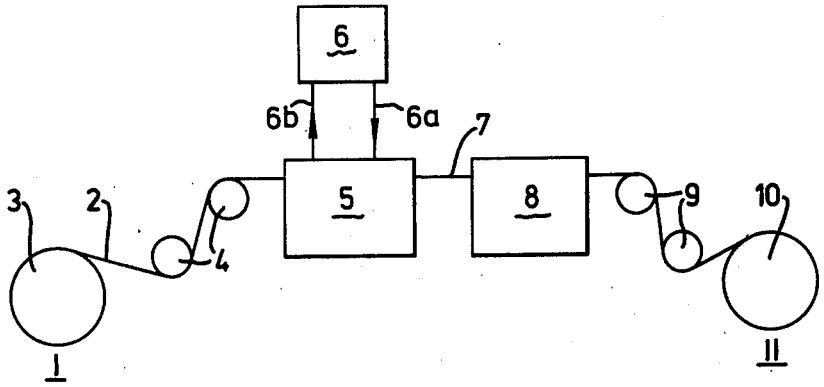
FIG. 1 is a block diagram showing the general arrangement of a paper coating machine.

Referring first to FIG. 1, a papercoating machine comprises an unwind station 1 at which paper 2 is unwound from a reel 3. The paper 2 is guided by rollers 4 to a blade coating apparatus 5, at which a foamed aqueous coating composition containing microcapsules, particulate stilt material and a binder is applied to the paper 2. After application of the coating, the coated paper 7 is dried in drying apparatus 8, and then passed over rollers 9 to be rewound on a reel 10 at a wind up station 11. The foamed coating composition is produced in a foaming apparatus 6, two alternative embodiments of which will be described hereafter. The foaming coating composition is supplied to the coating apparatus through a pipe 6*a*, and excess coating composition is returned through a pipe 6*b* to be re-foamed.

Figure 2:
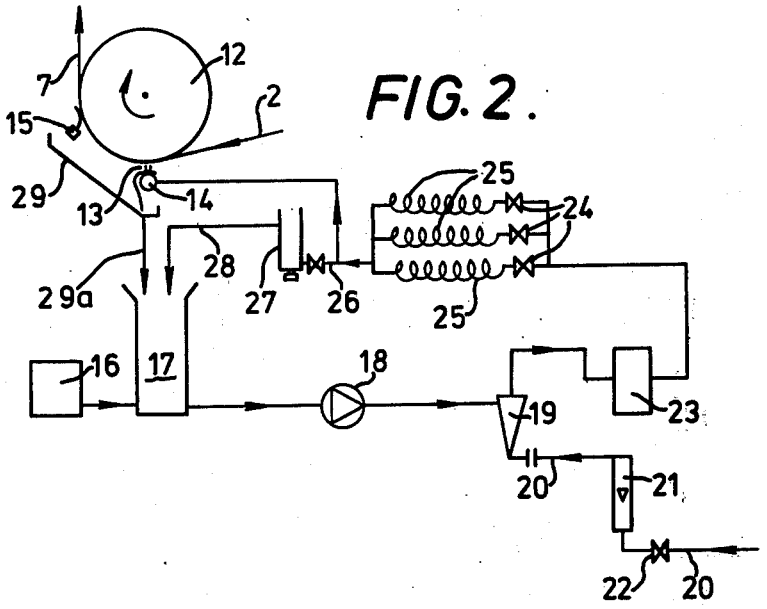
FIG. 2 is a flow diagram showing coating and foaming stations of such a machine.

Referring now to FIG. 2, the web 2 of paper to be coated passes round the underside of a support roll 12, and as it does so an excess of coating composition 13 is applied by means of a fountain applicator 14. A flexible blade 15 acting against the roll 12 smooths the coating and by scraping off excess coating composition, meters the coating to a desired thickness. The coated web 7 then passes to a drying station. The excess coating composition metered off is collected by a sloping tray 29 and returned through a pipe 29*a* to a collection tank 17 for re-foaming and re-use.

The manner in which the coating composition is foamed will now be described. Fresh coating composition is run from a storage tank 16 to the collection tank 17, from whence it is pumped by a pump 18 into the tangential inlet of a vortex cleaner 19 of the kind normally used for cleaning papermaking stock before it passes to the wire of a papermaking machine. Air is introduced into the vortex of the cleaner by means of a perforated tube at the bottom of the cleaner. The air line is shown as 20, and a flow meter 21 is interposed in the air line to monitor the amount of air introduced. A valve 22 permits control of air introduction, which of course determines the air content and thus the viscosity of the foam produced. The mixture of coating composition and air emerging from the vortex cleaner 19 passes to a high shear mixer 23, for example an Oakes in-line rotating shaft mixer. A foam containing coarse bubbles is thereby produced. The foam is then refined to give a smaller bubble size by passage through an arrangement of nozzles 24 and foam tubes 25. The arrangement in this case consists of three sets arranged in parallel, each set being one nozzle and one foam tube arranged in series. The foamed composition so produced then passes to the fountain applicator 14 for application to the web 2. A valved branch pipe 26 leading to an air-content measuring cell 27 enables the air content of the composition being coated to be monitored. Coating composition drawn off for air content measurement is returned to the collection tank 17 for re-foaming and re-use through a pipe 28.

Figure 3:
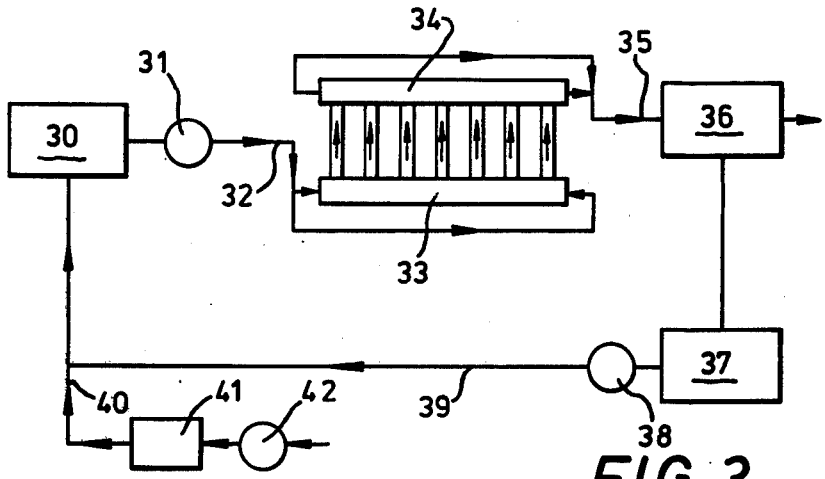
FIG. 3 is a flow diagram of an alternative foaming station.

Referring now to FIG. 3, there is shown an alternative foam generating apparatus, which comprises a closed in-line mixer 30, for example a closed tank containing a rotatable paddle, in which an aqueous coating composition containing microcapsules, binder and particulate stilt material is foamed. From the mixer 30 the dispersion is fed under pressure, about 25 to 30 pounds per square inch, by a pump 31 to an input pipe 32 to the inlet manifold 33 of a foam generator.

Foamed coating composition leaves an outlet manifold 34 through an output pipe 35 and is fed on to a fountain applicator 36 with which a flexible blade coater is associated. Excess coating composition is drained into a pan 37 and fed back by a pump 38 through a pipe 39 to the mixer 30 for re-use. Further coating components, either dry or as a dispersion, may be fed into the mixer 30 through a pipe 40 for dispersion in the re-cycled coating composition. Air under pressure is delivered to a metering device 41 by a compressor 42 or the like, and the device 41 delivers metered quantities of air into the pipe 40. The amount of air supplied is indicated by the metering device 41 and is controlled at a desired value.

Figure 4:
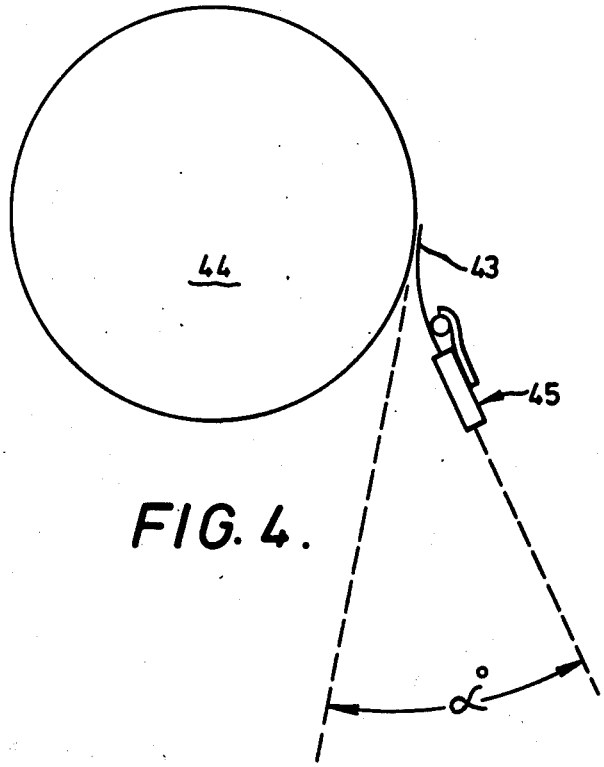
FIG. 4 is a diagram illustrating the manner in which a flexible blade can be adjusted to suit coating compositions of differing characteristics.

Referring now to FIG. 4, there is shown a flexible blade 43 bearing against a backing roll 44. The blade is supported in a blade holder generally designated 45. Holders for blades are well known in the papercoating industry, and so the construction of the holder 45 will not be described in detail herein. The position of the holder 45 and the position of the blade in the holder are adjustable, so as to vary the so-called blade angle $\alpha$ and blade extension as is also well known in the paper coating industry. The blade angle $\alpha$ is the angle between a tangent to the backing roll at the point of contact of the blade and the direction of the blade at the point where it emerges from the holder. The blade extension is the displacement between the end of the blade holder 45 and the tip of the blade, in its unflexed position.

The blade angle and blade extension can be adjusted as desired to suit a particular composition being coated. Generally it is desirable to increase the blade angle as the viscosity of the foamed coating composition increases. The preferred blade extension however does not appear to be so dependent on viscosity, and it is only desirable to adjust it (to lessen it) for higher viscosity mixes. The thickness of the blade again is not critical, and a typical blade thickness is of the order of 10 thou.

The invention will now be illustrated by the following Examples:

EXAMPLES 1 TO 70

These Examples are coating runs carried out to illustrate the broad applicability of the present method, and particularly that it can be used for:

a. compositions of differing air contents and viscosities b. compositions containing capsules having different wall materials c. compositions of different solids content d. coating different base papers e. coating at different speeds f. applying different coatweights g. compositions containing different stilt materials The results of the coating runs are shown in the following Table:

TABLE 1

| Example No. | Coating Comp. Type | % Air | Viscosity Cps. | Coat Wt. g/m² | Coating Pattern | Remarks |
|---|---|---|---|---|---|---|
| 1 | A | 58 | 430 | 6.1 | Excellent | |
| 2 | A | 57 | 520 | 6.8 | " | |
| 3 | A | 60 | 520 | 3.8 | Very good | |
| 4 | A | 58 | 455 | 5.4 | Excellent | |
| 5 | A | 59.5 | 457 | 5.4 | " | |
| 6 | A | 47.5 | 175 | 5.4 | Very good | |
| 7 | A | 57.7 | 515 | 6.2 | Excellent | |
| 8 | A | 63 | 610 | 5.8 | " | |
| 9 | A | 59.5 | 550 | 6.4 | " | |
| 10 | B | 55 | 700 | 6.4 | " | |
| 11 | B | 50 | 500 | 7.0 | Very good | Coating speed 550 m/min |
| 12 | B | 55 | 850 | 6.0 | Very good | Coating speed 725 m/min |
| 13 | B | 65 | 1560 | 6.6 | Very good | |
| 14 | B | 37 | 440 | 6.6 | Good | |
| 15 | B | 27 | 320 | 6.1 | " | |
| 16 | B | 56 | 910 | 5.6 | Excellent | |
| 17 | B | 59 | 1120 | 6.9 | Very good | |
| 18 | B | 62.5 | 900 | 6.7 | " | |
| 19 | B | 62.5 | 700 | 6.7 | Good | |
| 20 | B | 56 | 600 | 6.4 | Good | |
| 21 | B | 70 | 1820 | 7.0 | Very Good | |
| 22 | B | 70 | 1580 | 6.9 | Excellent | |
| 23 | B | 67 | 1080 | 7.4 | Good | |
| 24 | B | 55.0 | 1200 | 5.7 | Very Good | |
| 25 | B | 55 | 1200 | 5.9 | " | |
| 26 | B | 55 | 1200 | 5.0 | Good | |
| 27 | B | 55 | 1200 | 5.5 | " | |
| 28 | B | 55 | 1500 | 5.6 | " | |
| 29 | B | 55 | 1100 | 3.7 | Moderate | |
| 30 | B | 55 | 1100 | 3.5 | " | |
| 31 | B | 57 | 1070 | 3.8 | " | |
| 32 | B | 52.5 | 520 | 4.9 | " | PVA binder |
| 33 | B | 61.5 | 530 | 5.6 | Good | PVA binder |
| 34 | B | 64 | 640 | 6.7 | Very Good | PVA binder |
| 35 | B | 66.5 | 625 | 6.4 | " | PVA binder |
| 36 | B | 57.5 | 700 | 6.8 | Excellent | |
| 37 | B | 53 | 440 | 6.9 | " | Foam-laid base paper of substance 38 g/m² |
| 38 | B | 56.5 | 640 | 6.8 | Moderate | MG Base Smooth Side |
| 39 | B | 54.5 | 520 | 7.1 | Good | MG Base Rough Side |
| 40 | B | 60.5 | 980 | 6.1 | Very Good | Foam-laid base paper of substance 32 g/m² |
| 41 | B | 62.5 | 820 | 6.2 | Good | Wheatstarch stilt material |
| 42 | C | 40 | 920 | 6.3 | Moderate | |
| 43 | C | 55 | 1350 | 6.1 | Good | |
| 44 | D | 62 | 2740 | 6.5 | Moderate | |
| 45 | D | 61.5 | 3100 | 5.9 | " | |
| 46 | C | 66 | 1440 | 6.9 | Very Good | |
| 47 | E | 50 | 880 | 8.0 | " | |
| 48 | E | 55 | 1000 | 7.6 | " | |
| 49 | F | 50 | 1220 | 7.9 | Good | |
| 50 | F | 60 | 2200 | 5.9 | Very Good | |
| 51 | F | 37 | 1700 | 6.5 | Moderate | |
| 52 | F | 60 | 2900 | 6.1 | " | |
| 53 | F | 50 | 2100 | 6.3 | Good | |
| 54 | F | 53 | 2840 | 6.4 | " | |
| 55 | F | 62 | 3400 | 5.7 | " | |
| 56 | F | 57 | 2900 | 5.8 | " | |
| 57 | F | 57 | 2800 | 5.3 | Moderate | |
| 58 | F | 60 | 3400 | 6.1 | " | |
| 59 | F | 25 | 1680 | 5.8 | " | |
| 60 | F | 53 | 3120 | 6.1 | Good | |
| 61 | F | 70 | 2860 | 4.0 | Moderate | |
| 62 | F | 56 | 2200 | 6.1 | Good | |
| 63 | F | 48 | 1760 | 6.0 | " | |
| 64 | F | 53 | 1600 | 6.5 | Very Good | |
| 65 | F | 63 | 2500 | 6.1 | Excellent | |
| 66 | F | 59.5 | 2460 | 5.7 | " | |

TABLE 1-continued

| Example No. | Coating Comp. Type | % Air | Viscosity Cps. | Coat Wt. g/m² | Coating Pattern | Remarks |
|---|---|---|---|---|---|---|
| 67 | F | 57 | 2600 | 3.2 | Moderate | |
| 68 | F | 56.5 | 2350 | 6.2 | Good | |
| 69 | F | 50 | 2560 | 6.0 | Very Good | PVA binder |
| 70 | G | 51 | 2680 | 4.4 | Excellent | PVA binder |

Except where stated under "remarks" in the above Table, the base paper was a 49 g/m² sheet of the kind conventionally used in the commercial production of CB sheets, coating was carried out at a speed of 250 m/min on a pilot-scale coater, cellulose fibre floc was used as the stilt material, and casein was used as a binder and foaming agent, except for coating composition types E and F defined hereafter. The foam was generated in every case as described with reference to FIG. 2 of the accompanying drawings, and in every case the coating was applied by a fountain applicator and metered by a flexible blade. Coatweight variation was achieved by suitably varying the blade angle and blade extension. The viscosity was measured in each case using a Brookfield viscometer at 100 r.p.m. It will be seen that in certain cases, a particular air content gave rise to different viscosities with the same coating composition. One cause of this is thought to be the influence of different bubble sizes in the foam, and is to some extent a consequence of manual control of air content.

The key to the coating composition types referred to in Table 1 is as follows:

A — 18% solids content composition of which the capsules were prepared by coacervation from an aqueous mixture of gelatin, carboxymethyl cellulose and polyvinyl methyl ether - maleic anhydride copolymer (this technique is described generally in Example 1 of British Patent No. 1,053,935, except that gum arabic is used there instead of carboxymethyl cellulose).

B — 23% solids content composition of which the capsules were as in A.

C — 28% solids content composition of which the capsules were as in A.

D — 33% solids content composition of which the capsules were as in A.

E — 33% solids content composition of which the capsule walls were of ureaformaldehyde resin.

F — 38% solids content composition of which the capsules were as in E

G — 46% solids content composition of which the capsules were as in E

The coating compositions were made up as follows:

| | | % dry weights |
|---|---|---|
| types A to D | Capsules | 82.2 |
| | Solka floc | 14.8 |
| | Casein or PVA | 3.0 |
| Types A to D | Capsules | 84.4 |
| | Wheat starch | 12.6 |
| | Casein or PVA | 3.0 |
| Types E & F | Capsules | 81.5 |
| | Solka floc | 14.7 |
| | Starch (as binder) | 3.8 |
| (Jalan E11 supplied by Laing-National Limited) | | |

Triton X-165 was also used in composition types E and F as a foaming agent in an amount of 4% active weight based on total mix solids.

The references to foam-laid paper are to base paper made as generally described in British Patent No. 1 329 409.

Some typical blade parameters used in obtaining the results in Table 1 are detailed below (all viscosities are Brookfield at 100 r.p.m.):

1. Composition Type A

For a 58% air content foamed composition having a viscosity of 430 cps, coated at 61 g/m², the blade parameters were:

| | |
|---|---|
| extension | 1 7/16" |
| thickness (thou) | 10 |
| blade angle | 26° |

2. Composition Type B

For a 58% air content foamed composition having a viscosity of 700 cps, coated at 6.8 g/m², the blade parameters were:

| | |
|---|---|
| extension | 1 7/16" |
| thickness (thou) | 10 |
| blade angle | 38° |

3. Composition Type C

For a 67% air content foamed composition having a viscosity of 1640 cps, coated at 6.5 g/m² the blade parameters were:

| | |
|---|---|
| extension | 1 7/16" |
| thickness (thou) | 10 |
| blade angle | 43° |

4. Composition Type D

For a 51% air content foamed composition having a viscosity of 2560 cps, coated at 4.4 g/m², the blade parameters were:

| | |
|---|---|
| Blade extension | 1" |
| thickness (thou) | 10 |
| blade angle | 52.5° |

EXAMPLE 71

This example illustrates the coating of a paper web with a coating composition which had been foamed using the apparatus shown in FIG. 3 of the accompanying drawings.

Two coating compositions were prepared, of which the microcapsules of one contained gum arabic and the other carboxy methyl cellulose as one of the wall forming materials, (the others being gelatin and polyvinyl methyl ether - maleic anhydride copolymer). The stilt material was cellulose fibre floc, and the binder was casein.

In each case the formulation was:

| | | |
|---|---|---|
| microcapsules | 82.2 | parts dry weight |
| cellulose fibres | 14.8 | " |
| casein | 3.0 | " |

The following procedure was then carried out with each coating composition.

The coating composition was prepared at a solids content of 18% and the pH adjusted with sodium hydroxide solution to a value greater than pH 10.5.

The coating mix was foamed to desired air content in a foaming apparatus illustrated in FIG. 3 of the accompanying drawings. The air content of the foam was monitored by a device that measured the pressure head generated by a column of foam, the height of which was controlled by an overflowing weir device.

No increase in solids content of the coating composition was noticed during the coating run.

The foamed coating composition was applied to the paper web by a fountain applicator and excess coating composition was metered off by a flexible blade.

A comparative coating run was also made using an unfoamed coating composition applied by a roll applicator system with subsequent air-knife metering.

The coated paper was then tested for functional properties in the manner described in Comparative Example 1, with the results shown in Table II:

TABLE II

| Wall Material | Applicator System | % Air by Volume | Viscosity cP Brookfield Spin 3 100 rpm | Coating weight g/m² | Calender intensity %* | smudge resistance %* |
|---|---|---|---|---|---|---|
| Gum arabic | Fountain | 55 | 600 | 6.0 | 62 | 89 |
| | Roll | 46 | 290 | 7.0 | 66 | 85 |
| Carboxymethyl | Fountain | 41 | 250 | 4.6 | 64 | 88 |
| Cellulose | Roll | 48 | 305 | 6.1 | 52 | 87 |
| Gum arabic | Air knife Coated | Unfoamed | 50 | 6.0 | 63 | 87 |

*These tests are described in Comparative Example I hereafter

The similarity in functional properties of the above examples and the lack of increase in solids content of the coating mix in the recirculation loop indicates that there is no build up of cellulose fiber under the blade. The paper produced exhibited a uniform distribution of coating and a level sheet surface.

EXAMPLE 72

A coating mix consisting of:

| | | |
|---|---|---|
| Microcapsules | 82.2 | parts by dry weight |
| Cellulose fibres | 14.8 | " |
| Casein | 3.0 | " |
| Sodium hydroxide (20% solution) | 0.4 | " |

was prepared at a solids content of 24.5% and foamed as described in Example 71 to give foams of 48% and of 58% air content. These were applied to a paper web by a fountain applicator system, and excess coating was metered off by a flexible blade. The coated paper produced had a good coating pattern and sheet level. The paper was tested for functional properties and the results are given below in Table III:

| Viscosity cP Brookfield Spindle 3 100 rpm | % Air | Coating weight g/m² | Calender Intensity %* | Smudge resistance %* |
|---|---|---|---|---|
| 260 | 48 | 6.2 | 63 | 88 |
| 970 | 58 | 6.0 | 58 | 89 |

*These tests are described in Comparative Example I hereafter

EXAMPLE 73

A coating mix of the same formulation as that in Example 72 was prepared at a solids content of 23%. The mix was foamed by the system described in Example 71 to give an air content of 54%. The viscosity was found to be 470 cps. The foamed coating mix was applied to the web by a roll applicator system and excess coating was metered off by a flexible blade to give a coatweight of 6.3 g/m². The coated paper gave a calender intensity of 60% and a smudge resistance of 86%.

COMPARATIVE EXAMPLE I

In order to illustrate the functional properties of paper coated by the present method results are given in Table IV below of calender intensity (CI) and smudge resistance tests on paper produced in one of the Examples from Table I and on paper produced by conventional methods. In each case the composition contained casein binder, cellulose fibre floc stilt material, and gelatin/carboxymethyl cellulose/polyvinyl methyl ether - maleic anhydride copolymer capsules, and the blade was a flexible blade.

TABLE IV

| Solids Content | Method of Appln | Coat weight g/m² | Calender Intensity % | Smudge Resistance % |
|---|---|---|---|---|
| 18% | Roll air-knife | 5.5 | 56 | 89.6 |
| 23% | Roll/Blade (foamed) | 6.3 | 49.4 | 90.0 |
| 23% | Roll/Blade (unfoamed) | 5.4 | 51.4 | 74.0 |
| 23% | Fountain/Blade (foamed) | 6.4 | 45.5 | 87.0 |
| 23% | Fountain/Blade (unfoamed) | 5.7 | 47.0 | 77.4 |

It will be seen that the results obtained for the present method are comparable to that from conventional air-knife coating, and thus that paper coated by the present method has acceptable functional properties. However, the two examples in which a flexible blade is used with an unfoamed composition give poor results for smudge resistance, indicating that stilt material has not been sufficiently and evenly applied to the paper.

The calender intensity test described above is a standard one in the pressure-sensitive copying art and involves superimposing a strip of capsule-coated paper on a strip of co-reactant coated paper (i.e. CF paper) and passing the superimposed strips through a calender applying a pressure sufficient to rupture the capsules (e.g. 83 lbs per linear inch). The intensities of the print obtained after 48 hours and its background are then measured using an opacimeter, and the "calender intensity" is expressed as a percentage equal to (reflectance of print) × 100 divided by (reflectance of background). Thus the lower the value of print intensity the more intense is the print.

The smudge resistance test, also a standard one in the pressure-sensitive copying art is designed to measure the resistance of the capsules to premature rupture and involves drawing a weighted co-reactant coated sheet over a capsule coated sheet and measuring the reflectance and background readings for the print obtained on the co-reactant sheet. The result is expressed as a percentage as for calender intensity. However, for smudge resistance, the higher the result the better the resistance to premature rupture.

COMPARATIVE EXAMPLE II

It has previously been stated that the use of a blade coating technique with an unformed coating composition results in selective removal of stilt material from the coating composition by the blade, and subsequent return of the stilt material to the coating composition applicator pan with excess coating composition metered off by the blade. This Example demonstrates this effect.

30 minute coating runs were carried out for initially identical foamed and unfoamed coating compositions containing cellulose fibre floc as a stilt material. The composition was applied by a fountain applicator and metered by a flexible blade. The initial solids content of the composition was 23%. After the runs, there was no measurable increase in the solids content of the foamed composition, but the solids content of the unfoamed composition was 27%. This increase in solids content is due to the previously described effect of selective removal of stilt material and its return to the coating composition to be coated.

The Example was then repeated using Wheat starch as the stilt material instead of cellulose fibre floc, and again an increase from 23% to 27% in solids content was observed for the unfoamed mix, while the solids content of the foamed mix remained stable.

COMPARATIVE EXAMPLE III

This Example also demonstrates the fact that selective removal of stilt material occurs using an unfoamed coating composition.

Composition type B was used, and was coated foamed and unfoamed using a fountain applicator and a rigid trailing blade for metering off excess coating composition. Cellulose fibre floc was used as the stilt material. The paper obtained was then tested for smudge resistance as described previously. For the foamed coating composition, the smudge resistance was 89%, and for the unfoamed coating composition 84%, indicating that the latter was more susceptible to premature capsule rupture, i.e. it carried less stilt material.

What we claim is:

1. A method of coating a web of paper with pressure sensitive microcapsules containing a color forming material, for use in pressure sensitive copying systems, which method consists essentially of the following sequential steps:

a. forming in a mixing zone an aqueous coating composition containing dispersed therein said microcapsules, particulate stilt material of a size greater than that of the microcapsules and in an amount sufficient to protect said microcapsules against premature rupture, and a binder in an amount sufficient to enhance the adhesion of the microcapsules and the particulate stilt material to the web;

b. foaming said composition to impart to it a gas content of at least about 25% and a gas bubble size predominantly in the range of 10 to 100 μm;

c. applying said foamed composition to the web at a coating speed of at least about 250 m/min.;

d. metering the foamed composition on the web by means of a mechanical metering member which is in contact with the foamed coating composition on the web and smooths it to a uniform desired coatweight;

e. returning metered off coating composition to said mixing zone, and f. drying the metered foamed coating composition on the web.

2. A method as claimed in claim 1 wherein the metering member is a flexible blade which flexes in the direction of the web movement such that the web runs substantially tangentially to the blade.

3. A method according to claim 1 wherein a binder and a separate foaming agent are included in the composition prior to foaming it.

4. A method according to claim 1 wherein said binder itself produces an adequate foam when the composition is foamed.

5. A method as claimed in claim 1 wherein the metering member is a blade.

6. A method as claimed in claim 2 wherein the foamed composition is applied to the web by means of a fountain applicator.

7. A method as claimed in claim 1 wherein the gas content of the foamed composition is from 45 to 70%.

8. Sheet material which has been coated by a method as claimed in claim 1.

* * * * *